US010526131B2

(12) United States Patent
Kingswell et al.

(10) Patent No.: US 10,526,131 B2
(45) Date of Patent: Jan. 7, 2020

(54) SWEEP BEAD DISPENSER

(71) Applicant: Toly Management Ltd., Zejtun ZTN (MT)

(72) Inventors: James Attard Kingswell, Saint Julians (MT); David James Sciberras, Zabbar (MT)

(73) Assignee: TOLY MANAGEMENT LTD., Zejtun (MT)

( * ) Notice: Subject to any disclaimer, the term of this patent is extended or adjusted under 35 U.S.C. 154(b) by 16 days.

(21) Appl. No.: 16/011,064

(22) Filed: Jun. 18, 2018

(65) Prior Publication Data

US 2018/0370714 A1 Dec. 27, 2018

Related U.S. Application Data

(60) Provisional application No. 62/522,790, filed on Jun. 21, 2017.

(51) Int. Cl.

| | |
|---|---|
| ***B65D 83/04*** | (2006.01) |
| ***A61J 1/03*** | (2006.01) |
| ***B65D 83/02*** | (2006.01) |
| ***B65D 51/20*** | (2006.01) |
| ***B65D 3/08*** | (2006.01) |

(52) U.S. Cl.

CPC ..... *B65D 83/0427* (2013.01); *A61J 1/03* (2013.01); *B65D 3/08* (2013.01); *B65D 51/20* (2013.01); *B65D 83/02* (2013.01); *B65D 83/0409* (2013.01); *B65D 83/0454* (2013.01); *B65D 2583/049* (2013.01); *B65D 2583/0468* (2013.01); *B65D 2583/0481* (2013.01)

(58) Field of Classification Search

CPC ..... F41B 11/53

See application file for complete search history.

(56) References Cited

U.S. PATENT DOCUMENTS

| | | | |
|---|---|---|---|
| 2,693,873 | A | 11/1954 | Martin |
| 3,176,535 | A | 4/1965 | Rowland |

(Continued)

FOREIGN PATENT DOCUMENTS

| | | |
|---|---|---|
| CA | 1088859 | 11/1980 |
| FR | 1200571 | 12/1959 |

(Continued)

*Primary Examiner* — Jacob S. Scott
*Assistant Examiner* — Ayodeji T Ojofeitimi
(74) *Attorney, Agent, or Firm* — Wissing Miller LLP

(57) ABSTRACT

A single-bead dispenser including a container for holding plural beads in a spherical chamber, a wiper disposed within and rotatable about a horizontal axis of the chamber to sweep the inner wall of the chamber and transport a single contained bead upwardly from the chamber to an opening for discharge to a manually accessible platform on the container while leaving all the other contained beads in the chamber, a geared ring mounted externally of the container and manually rotatable about a vertical axis of the chamber, and a gear secured to the wiper and engaged and driven by the geared ring for effecting sweeping rotation of the wiper when the ring is turned. The wiper may be a lune of a hollow sphere close to and concentric with the chamber inner wall and may bear a dispensing scoop shaped to capture and convey a single bead to the opening.

15 Claims, 16 Drawing Sheets

(56) References Cited

U.S. PATENT DOCUMENTS

| | | | | |
|---|---|---|---|---|
| 3,715,055 | A | 2/1973 | Kendrick et al. | |
| 4,560,086 | A | 12/1985 | Stol | |
| 4,887,816 | A | 12/1989 | Hanna | |
| 4,965,951 | A | 10/1990 | Miller | |
| 5,213,232 | A | 5/1993 | Kraft et al. | |
| 5,542,570 | A | 8/1996 | Nottingham et al. | |
| 5,592,760 | A | 1/1997 | Kohout | |
| 5,884,806 | A | 3/1999 | Boyer | |
| 6,039,208 | A * | 3/2000 | Lambelet, Jr. | B65D 83/0454 221/197 |
| 6,860,403 | B1 | 3/2005 | Mehrens et al. | |
| 7,204,391 | B2 | 4/2007 | Toker | |
| 7,314,131 | B2 | 1/2008 | Olds | |
| 8,727,180 | B2 | 5/2014 | Zonana et al. | |
| 9,501,626 | B2 | 11/2016 | Zhang et al. | |
| 2005/0189373 | A1 | 9/2005 | Aylward | |
| 2006/0086347 | A1* | 4/2006 | Hedberg | F41B 11/53 124/51.1 |
| 2006/0086592 | A1 | 4/2006 | Olds | |
| 2008/0099310 | A1 | 5/2008 | Olds | |
| 2008/0116219 | A1* | 5/2008 | Lawrence | G07F 11/54 221/265 |
| 2009/0145724 | A1* | 6/2009 | Garthaffner | A24D 3/0216 198/478.1 |
| 2009/0166376 | A1* | 7/2009 | Garthaffner | A24D 3/0216 221/282 |
| 2011/0120354 | A1 | 5/2011 | Riemens | |
| 2014/0053821 | A1* | 2/2014 | Hedberg | F41B 11/53 124/51.1 |
| 2014/0239006 | A1* | 8/2014 | Garthaffner | B65G 47/1428 221/1 |
| 2014/0353327 | A1 | 12/2014 | Bae et al. | |
| 2015/0001245 | A1 | 1/2015 | Kroll et al. | |
| 2015/0129603 | A1* | 5/2015 | Koike | A61J 7/02 221/13 |
| 2015/0226515 | A1* | 8/2015 | Tseng | F41B 11/53 221/265 |
| 2015/0266654 | A1 | 9/2015 | Baarman et al. | |
| 2016/0038377 | A1* | 2/2016 | Tegborg | A61J 7/02 221/1 |
| 2016/0120760 | A1 | 5/2016 | Nazginov | |
| 2016/0167866 | A1* | 6/2016 | Omura | B65B 35/06 221/173 |
| 2016/0193113 | A1* | 7/2016 | Jacobs | B65D 83/04 |

FOREIGN PATENT DOCUMENTS

| | | |
|---|---|---|
| JP | 2001-048287 | 2/2001 |
| JP | 3075575 | 2/2001 |
| KR | 10-1998-0709364 | 11/1998 |
| KR | 20-2003-0021454 | 7/2003 |
| KR | 20-2003-0027827 | 8/2003 |
| KR | 20-2008-0003947 | 9/2008 |
| KR | 10-20110076853 | 7/2011 |
| KR | 20030021454 | 7/2011 |
| KR | 201110076853 | 7/2011 |
| KR | 10-1202811 | 11/2012 |
| KR | 10-1342843 | 12/2013 |
| KR | 20140141277 | 12/2014 |
| WO | 2000064783 | 11/2000 |
| WO | 20110154448 | 12/2011 |

* cited by examiner

SWEEP BEAD DISPENSER

CROSS REFERENCE TO RELATED APPLICATION

This application claims the benefit, under 35 U.S.C. § 119(e), of U.S. provisional patent application No. 62/522,790 filed Jun. 21, 2017, the entire disclosure of which is incorporated herein by this reference.

BACKGROUND OF THE INVENTION

This invention relates to dispensers for holding a plurality of beads and delivering the beads singly, one by one, upon turning of a manually rotatable element on the dispenser.

A variety of products, including (without limitation) cosmetics, drugs, nutritional supplements and foods, are commonly prepared in the form of capsules or other similarly shaped and sized bodies (e.g. pills, pellets, and tablets) which are at least externally solid and are self-sustaining in shape under normal storage conditions but may be more or less fragile when subjected to impacts or handled roughly. The term "beads" herein embraces such capsules, pills, pellets, tablets and the like.

A typical container for beads is constituted of a receptacle for holding a plurality of the beads and a removable lid or cap for closing the receptacle. To obtain one or more beads from the container, a user may take off the lid and tilt the open receptacle to cause beads to fall out, or reach into the receptacle to remove beads with the fingers.

Such operations present problems in that tilting of an open receptacle may cause an undesired excess of beads to fall out, while manual extraction of beads from within the receptacle is often manipulatively difficult. In either case, there is danger that beads not intended to be withdrawn may be contaminated by contact with surfaces outside the container or with the user's fingers inside the container. If the beads are of low strength (as exemplified, in particular, by some cosmetic capsules), attempted extraction with the fingers may damage or break them.

Bead dispensers have heretofore been proposed for overcoming these difficulties by providing for individual discharge of single beads from a container, i.e., one at a time. Such devices, however, may not reliably ensure desired single-bead discharge, may be structurally complex or inconveniently complicated to manipulate, and may exert sufficient force or pressure on the beads to cause disruption, damage or breakage, for instance if the beads are weak or tend to become stuck to each other and/or to the container in which they are held.

SUMMARY OF THE INVENTION

An object of the present invention is to provide a new and improved dispenser for delivering individual beads one at a time from a container holding a plurality of the beads, with high reliability of single-bead discharge. Another object is to provide such a dispenser which is capable of dispensing beads without subjecting them to harsh mechanical action, instead handling them gently, thereby to prevent damage to or breakage of even very weak or soft beads. A further object is to provide such a dispenser in which the container is swept to ensure that the entire bead-holding chamber is cleared of beads that may tend to stick to each other or to the container wall. Yet other objects include structural and manipulative simplicity, in particular small number of parts and single-twist bead delivery without need for plural initial priming turns; ease of filling; and ability to be modified with minimal substitution of parts for changing the diameter of beads to be dispensed.

To these and other ends, the present invention broadly contemplates the provision of a sweep bead dispenser comprising a container for holding plural beads in a chamber having an inner wall which is a surface defined by revolution of a generatrix about a horizontal axis, the container having an externally accessible platform at the top and an opening for discharging individual beads from the chamber to the platform; a wiper disposed within, and rotatable about the aforesaid horizontal axis of, the chamber for sweeping the chamber inner wall to capture a single bead and convey the captured bead upwardly to the opening for discharge to the platform while leaving all other beads of the contained plurality within the chamber; a first gear mounted on the container for manual rotation; and a second gear secured to the wiper and driven by the first gear for effecting sweeping rotation of the wiper when the first gear is turned. The second gear may be smaller than the first gear whereby an angular displacement of the first gear effects a greater angular displacement of the wiper. The wiper may extend along the chamber inner wall for at least substantially the entire distance between opposite intersections of the aforesaid horizontal axis with the chamber inner wall, and may comprise a wiper member bearing a dispensing scoop shaped and dimensioned to capture a single bead and convey the captured bead upwardly to the opening for discharge to the platform as aforesaid, wherein the wiper member is a rigid sheet or plate conforming in contour to a portion of the aforesaid surface of revolution and closely adjacent the chamber inner wall, so that when the wiper sweeps the chamber, beads not captured by the dispensing scoop flow over the wiper back into the chamber. Preferably the chamber inner surface has a lowermost point lying in a vertical plane that bisects the dimension of the chamber measured along the aforesaid horizontal axis, the dispensing scoop is disposed centrally on the wiper to rotate therewith in the same vertical plane, and the opening is located in register with the plane for receiving a bead from the dispensing scoop. In an upper portion of the chamber, the surface of revolution may be interrupted by the platform and the opening In an important exemplary and currently particularly preferred aspect, the aforesaid generatrix is a circle, and the chamber-defining inner wall is consequently spherical. The sweep bead dispenser of the invention, in this aspect, comprises a container for holding plural beads in a chamber defined by a spherical inner wall, the container having an externally accessible platform at the top and an opening for discharging individual beads from the chamber to the platform; a wiper disposed within, and rotatable about a horizontal axis of, the chamber for sweeping the chamber inner wall to capture a single bead and convey the captured bead upwardly to the opening for discharge to the platform while leaving all other beads of the contained plurality within the chamber; a first gear mounted on the container for manual rotation; and a second gear secured to the wiper and driven by the first gear for effecting sweeping rotation of the wiper when the first gear is turned. Advantageously the first gear may be a geared ring mounted on the container for manual rotation about a vertical axis of the chamber, and the second gear, secured to the wiper, meshes with and is driven by the geared ring. The terms "horizontal axis of the chamber" and "vertical axis of the chamber" refer to axes of rotation of the wiper and geared ring that respectively extend horizontally and vertically through the geometric center of the sphere defined by the aforesaid inner wall.

Preferably or conveniently, the container may include a jar with a semispherical inner wall constituting a lower portion of the chamber inner wall, and a platform member including the platform, the opening, and a dome with a semispherical inner wall constituting an upper portion of the chamber inner wall. The wiper may include a member shaped as a lune of a hollow sphere concentric with and closely adjacent the chamber inner wall such that when the wiper sweeps the chamber inner wall it displaces all beads held in the chamber, and a dispensing scoop fixedly mounted in a central location of the wiper and configured to capture and transport a single one of the contained beads to the opening as the wiper sweeps upwardly, for discharge of that single bead through the opening to the platform, while all other contained beads remain in the chamber.

The dispenser may also include a base surrounding the jar, a cap surrounding the platform member and threaded on the base, and a gasket disposed between and engaging the jar and the cap for sealing the container.

Desirably, when the container is not being used to discharge beads and the cap is threaded on the base, the opening is effectively blocked to prevent escape of beads from the chamber through the opening onto the platform, as may otherwise occur, for example, if the dispenser (with closed cap) is being carried in a handbag and becomes tilted. Such blocking of the opening may be provided by positioning and maintaining the wiper at its extreme bead-delivering position adjacent the opening except when the wiper is being intentionally and positively subjected to rotation by manual turning of the geared ring. Thus, the wiper may be automatically held at a selected end of its rotational path (e.g. the path end adjacent the opening) upon manual release of the geared ring; illustratively, the wiper may be subjected to a bias force such that it is moved to or held at the selected path end upon manual release of the geared ring.

Additionally or alternatively, the cap may have an inner surface with a post projecting inwardly along the vertical axis of the chamber, the post being positioned and dimensioned to block beads within the chamber from passing outwardly through the opening when the cap is mounted on the base and to enable the cap to be mounted on and removed from the base clear of interference between the post and structure defining the opening and platform.

Further features and advantages of the invention will be apparent from the detailed description set forth below, together with the accompanying drawings.

DETAILED DESCRIPTION

The illustrated embodiment of the invention is a generally spheroidal bead dispenser 10 dimensioned to be held in a user's hand, for containing a plurality of beads 11 (e.g. spherical cosmetic-containing capsules) of uniform size and dispensing the beads one by one when operated manually by the user.

Figure 9:
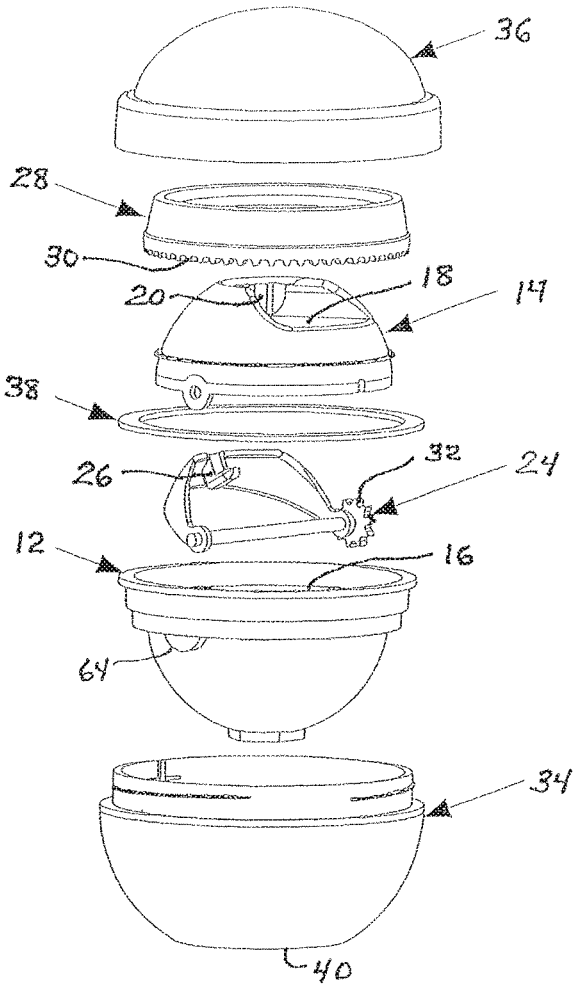
FIG. 9 is an exploded perspective view of the dispenser of FIG. 1.
Figure 10A:
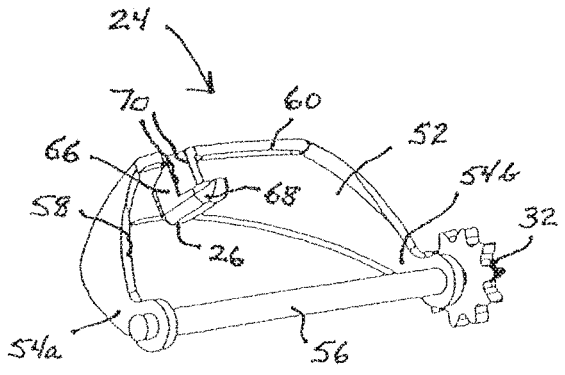
FIGS. 10A and 10B are somewhat enlarged front and rear perspective views of the wiper shown in FIG. 9.
Figure 10B:
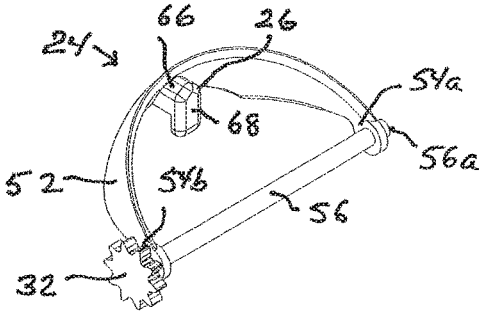

With reference to FIG. 9, the dispenser includes a jar 12 and a domed platform member 14 (each conveniently an integrally molded, generally rigid plastic element) non-removably snapped together and cooperatively constituting a container with a spherical internal chamber 16 for holding the plurality of beads. The top of the platform member is formed with a generally horizontal, externally manually accessible platform 18 and an orifice or opening 20 through which beads 11 are singly discharged from the chamber onto the platform where they can be picked up by the user's fingers.

Also included in the dispenser is a wiper 24 mounted within the chamber 16 for bidirectional rotary movement about a horizontal axis extending through the center of the spherical chamber. The wiper is shaped and dimensioned to sweep closely along the spherical inner wall of the chamber as it rotates. At its center, the wiper bears a fixed dispensing scoop 26 configured to engage, capture and transport a single one of the beads within the chamber each time the wiper is rotated forwardly through the bottom of the chamber and thence upwardly to the opening 20, so as to deliver the single transported bead through the opening and out onto the platform 18. The wiper disturbs and displaces the other contained beads as it sweeps along the chamber wall but does not lift them to the opening; instead, they flow or pass over the advancing wiper and fall back into the bottom of the chamber.

Additionally, the dispenser includes an externally manually accessible geared ring 28, mounted on the exterior of the domed platform member 14 so as to be bidirectionally rotatable about a vertical axis extending through the center of the spherical chamber 16 and having an array of depending gear teeth 30 extending for a full 360° around and closely adjacent the lower part of the external domed surface of the platform member. A smaller, peripherally toothed gear 32 is secured to the wiper 24 for rotation therewith on the horizontal axis of wiper rotation, and positioned at the side of the chamber to mesh with and be driven by the geared ring 28, such that manual rotation of the geared ring in one direction causes the wiper to sweep forwardly and upwardly (toward the opening 20) within the chamber for delivering one bead to the opening, while rotation of the geared ring in the opposite direction causes the wiper to sweep rearwardly (away from the opening) and downwardly within the chamber, to a position from which it can begin a new cycle of forward and upward sweeping to deliver another bead to the opening.

The entire dispenser structure is enclosed within a housing including a generally hemispherical, flat-bottomed base 34 surrounding the jar 12 and a generally hemispherical screw cap 36 surrounding the domed platform member 14 and geared ring 28, the cap being removably threaded on the base. A gasket 38, surrounding the geared ring and engaged by the jar and the cap, provides air-tight sealing of the interior of the dispenser.

It will be understood that terms such as "top," "bottom," "upwardly," "downwardly," "horizontal" and "vertical" herein refer to the dispenser when resting with the flat bottom 40 of the base 34 on a flat horizontal surface, and are used to define relative positions and orientations of features of the dispenser.

More particularly, referring to FIGS. 5-8B, the jar 12 has a semispherical (in this case, fully hemispherical) inner wall 42 easily fillable with beads, and a stepped circular outer flange 44 extending outwardly and upwardly from the top edge of wall 42. The platform member 14 has a dome 46 defining a semispherical inner wall 48 of the same radius as wall 42 with a lower edge that seats on the top edge of wall 42 (within the flange 44) so as to constitute therewith an inner wall, for chamber 16, that is a complete, continuous sphere except in the upper portion of the dome. The sphere is incomplete at the top of the dome, which is formed with the horizontal platform 18, externally manually accessible from above though laterally enclosed by side structure 50 to prevent beads from rolling or dropping off the platform, and is also formed with the opening 20 for passage of individual beads from the chamber to the platform. This opening is situated at the upper limit of upward and forward bead-delivering sweeping motion of the wiper 24, in register with the location of dispensing scoop 26 when the wiper reaches that upper limit. It will accordingly be understood that terms such as "spherical chamber" and "spherical inner wall" embrace the illustrated dispenser structure in which the region at and adjacent the top of the chamber is non-spherical so as to provide the platform 18 and opening 20.

The wiper 24 includes a rigid member 52 (e.g. molded of plastic) having the general form of a lune of a hollow sphere. A lune is a part of the surface of a sphere bounded by two great circles of the sphere; it has arcuate long edges and terminates in opposed points or apices respectively located at opposite ends of a diameter of the sphere. The term "lune of a hollow sphere" herein refers to a curved plate having outer and inner major surfaces which are substantially lunes of the concentric outer and inner surfaces of a hollow sphere or spherical shell. In the illustrated dispenser, the hollow sphere of which the member 52 is a lune has an outer diameter slightly smaller than the inner diameter of the spherical chamber 16. The opposed ends or points 54*a*, 54*b* of member 52 are fixedly secured to a spindle 56 that extends between and beyond them, and gear 32 is fixed on the spindle at a location spaced beyond point 54*b*, so that the member 52, spindle 56 and gear 32 (preferably integrally molded as a unit) rotate together. As shown, the forward edge 58 of member 52 (i.e., the leading edge of the member when the wiper rotates forwardly and upwardly toward opening 20) may have a straight central portion 60 that does not conform to the notional great circle generally defining edge 58 but is instead parallel to the rotational axis of the wiper; hence, the term "lune of a hollow sphere" describing the configuration of wiper member 52 embraces a shape which may have a forward edge with a straight central portion. The edges of member 52 are rounded to prevent damage to beads 11 with which they come in contact, and the thickness of member 52 is substantially smaller than the diameter of the beads, so that as the beads are engaged by the sweeping wiper, they are not carried upwardly but pass over the rounded leading edge and inner surface of the wiper to return to the bottom of the chamber.

Figure 11A:
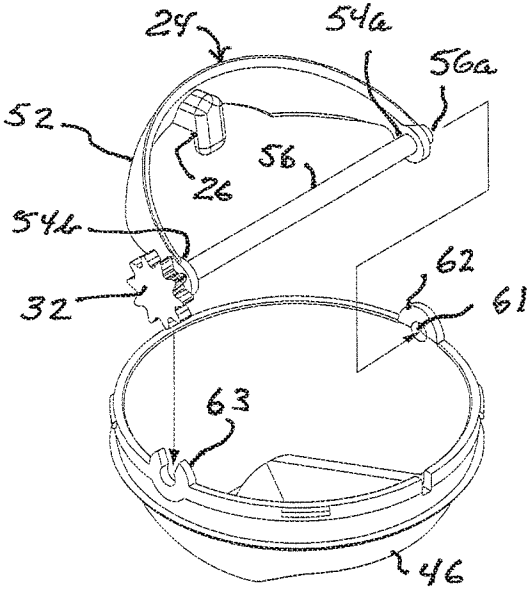
FIGS. 11A and 11B are perspective views illustrating the assembly of the wiper and the platform member.
Figure 11B:
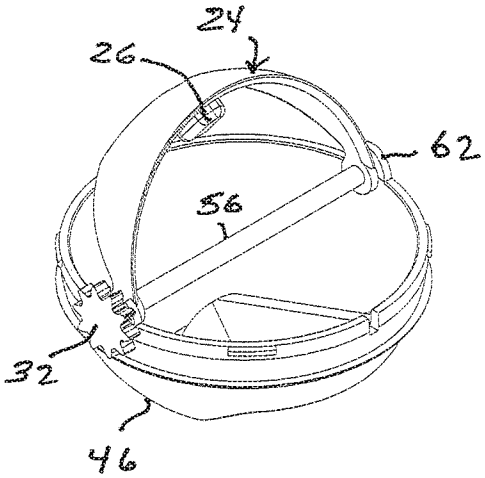

The free end 56*a* of spindle 56 extending beyond point 54*a* of member 52 is inserted in a hole 61 of a downwardly projecting socket 62 of the lower edge of dome 46 at one end of a horizontal diameter of chamber 16, while the portion of the spindle between gear 32 and point 54*b* of member 52 is snapped into a clip socket 63 formed in the lower edge of dome 46 diametrically opposite hole 61 (see FIGS. 11A and 11B). The upper portion of jar 12 is shaped to receive these sockets 62 and 63 as respectively indicated at 64*a* and 64*b*. Thus mounted, the wiper member 52 is disposed concentrically within and closely adjacent the spherical inner wall defining chamber 16, and is bidirectionally rotatable, about a horizontal axis containing the geometric center of the chamber, between at least the rearward position shown in FIG. 8A and the forward position (at opening 20) that it is approaching in FIG. 8B.

Figure 12B:
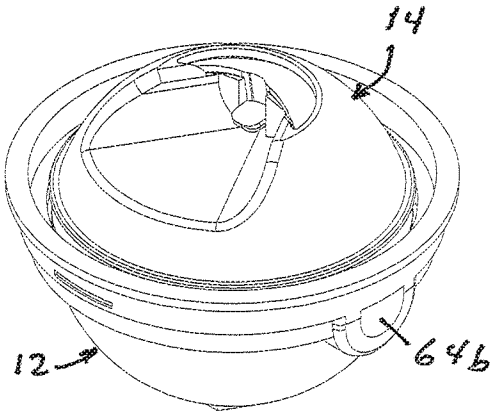
FIGS. 12A and 12B are perspective views illustrating the assembly of the platform member and the jar.
Figure 12A:
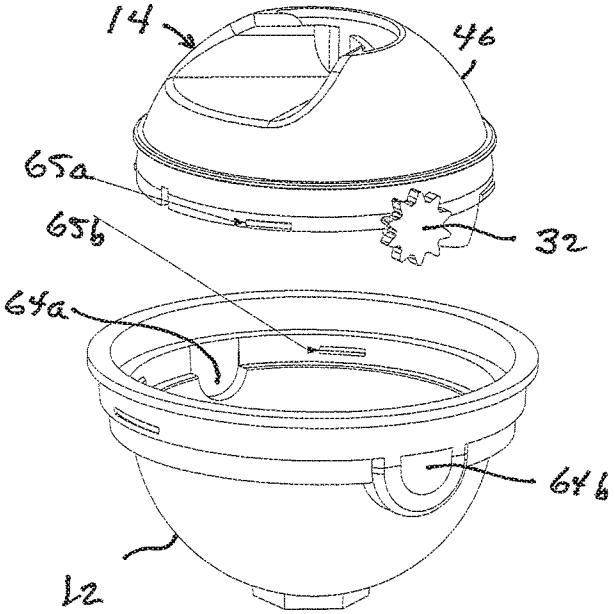

After the wiper is mounted in the platform member 14 as just described, the platform member is non-removably secured to the jar 12 by means of sets of four interfitting snap features 65*a* and 65*b* (FIGS. 12A and 12B) respectively molded on facing annular side surfaces of the platform member and jar.

Figure 1:
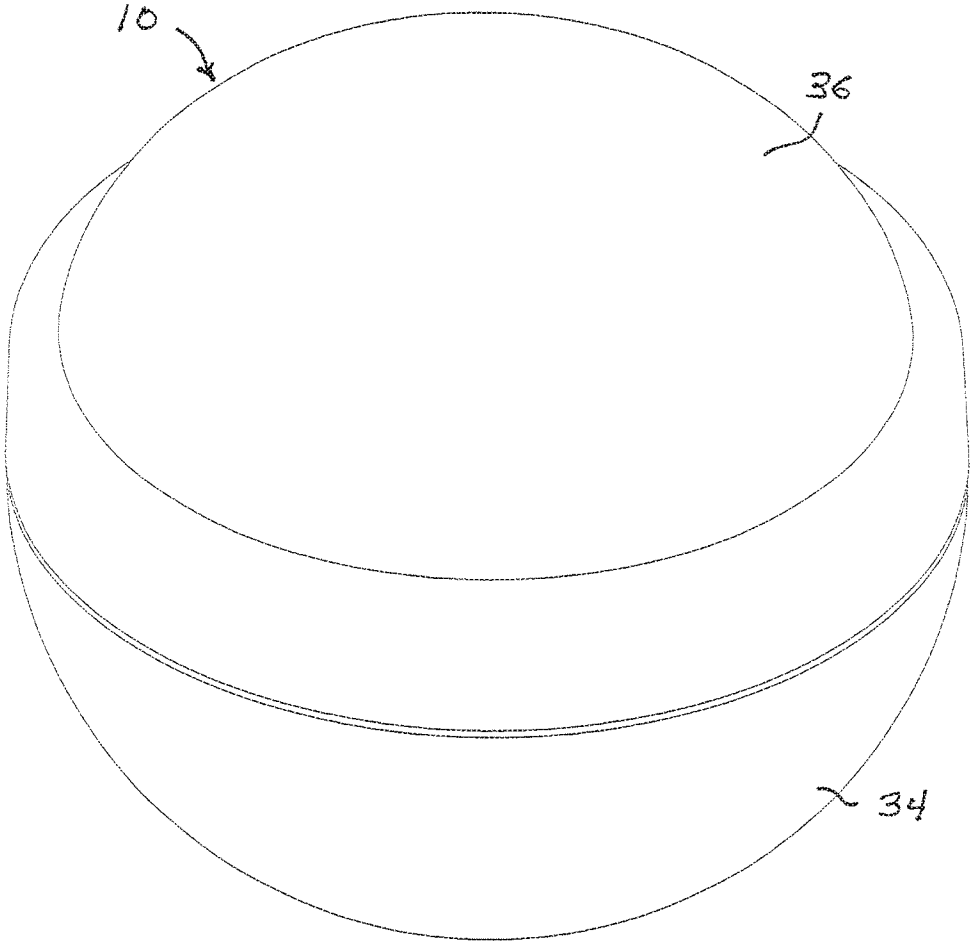
FIG. 1 is a perspective view of a sweep bead dispenser embodying the present invention in a particular form.
Figure 2:
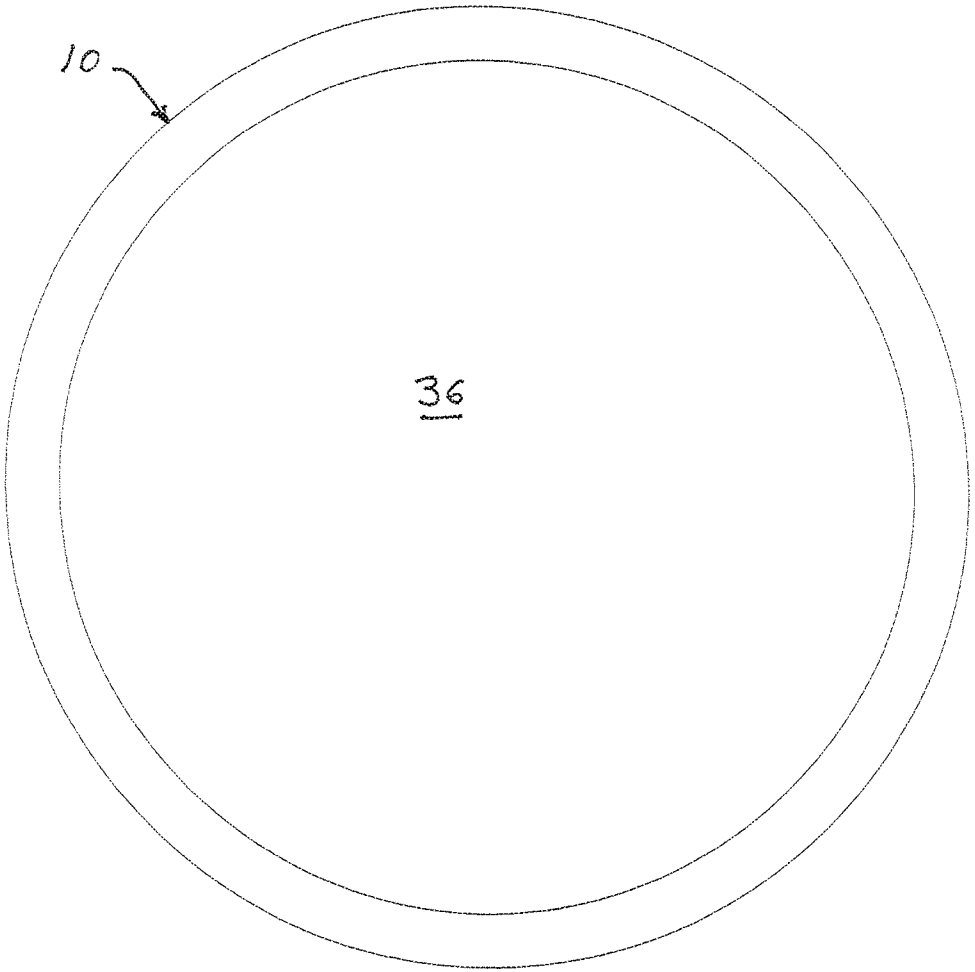
FIG. 2 is a top plan view of the same dispenser.
Figure 3:
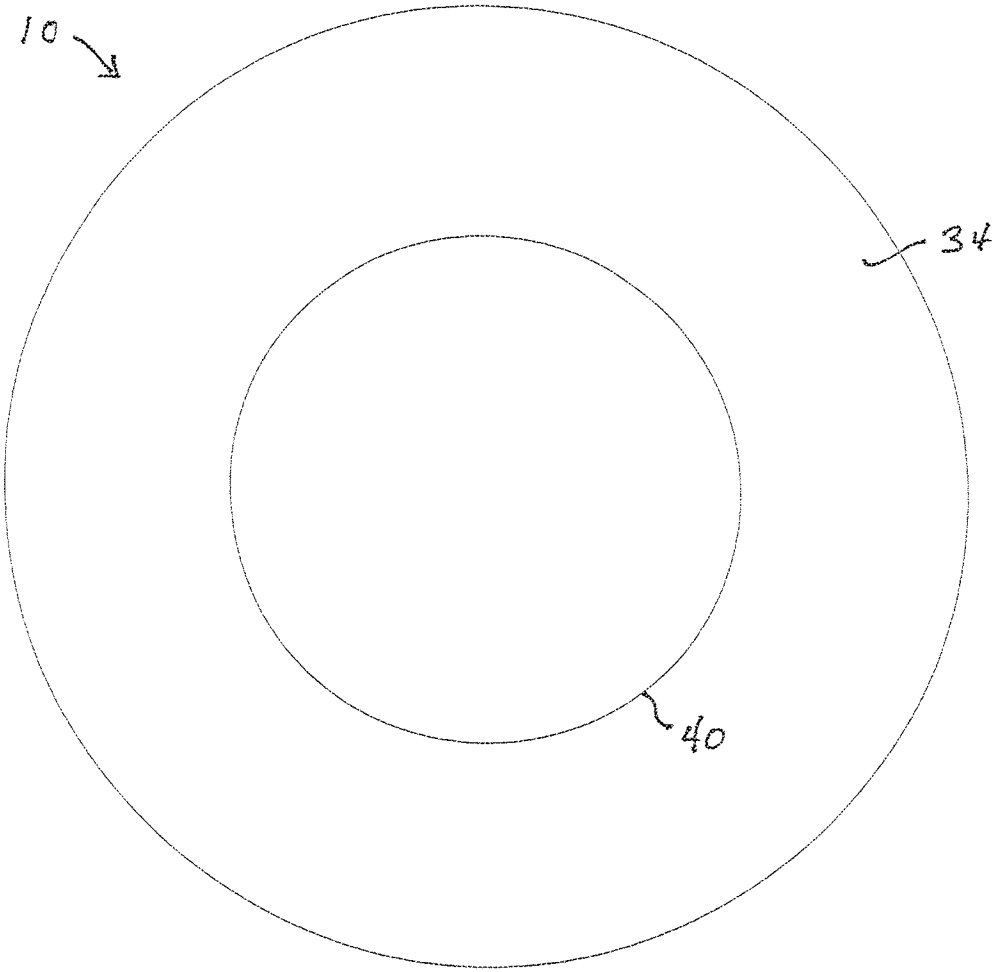
FIG. 3 is a bottom view of the same dispenser.
Figure 4:
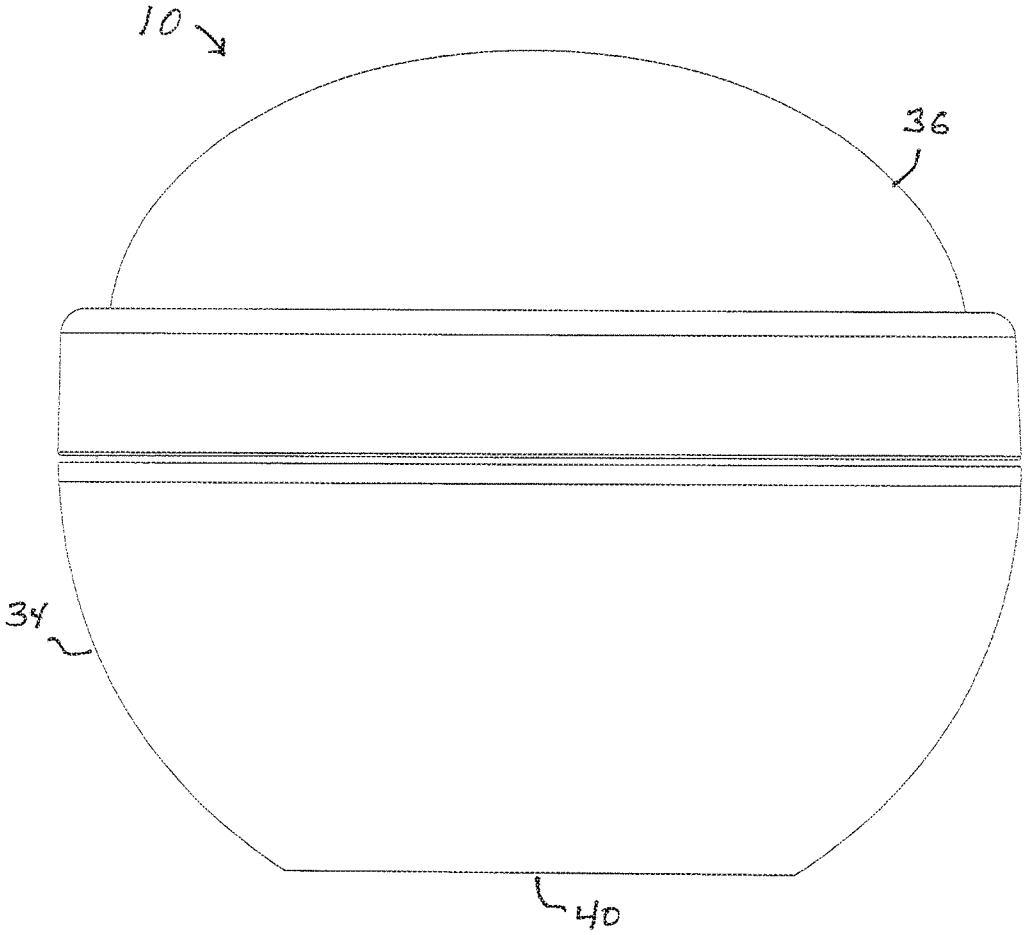
FIG. 4 is an elevational view of the same dispenser.
Figure 5:
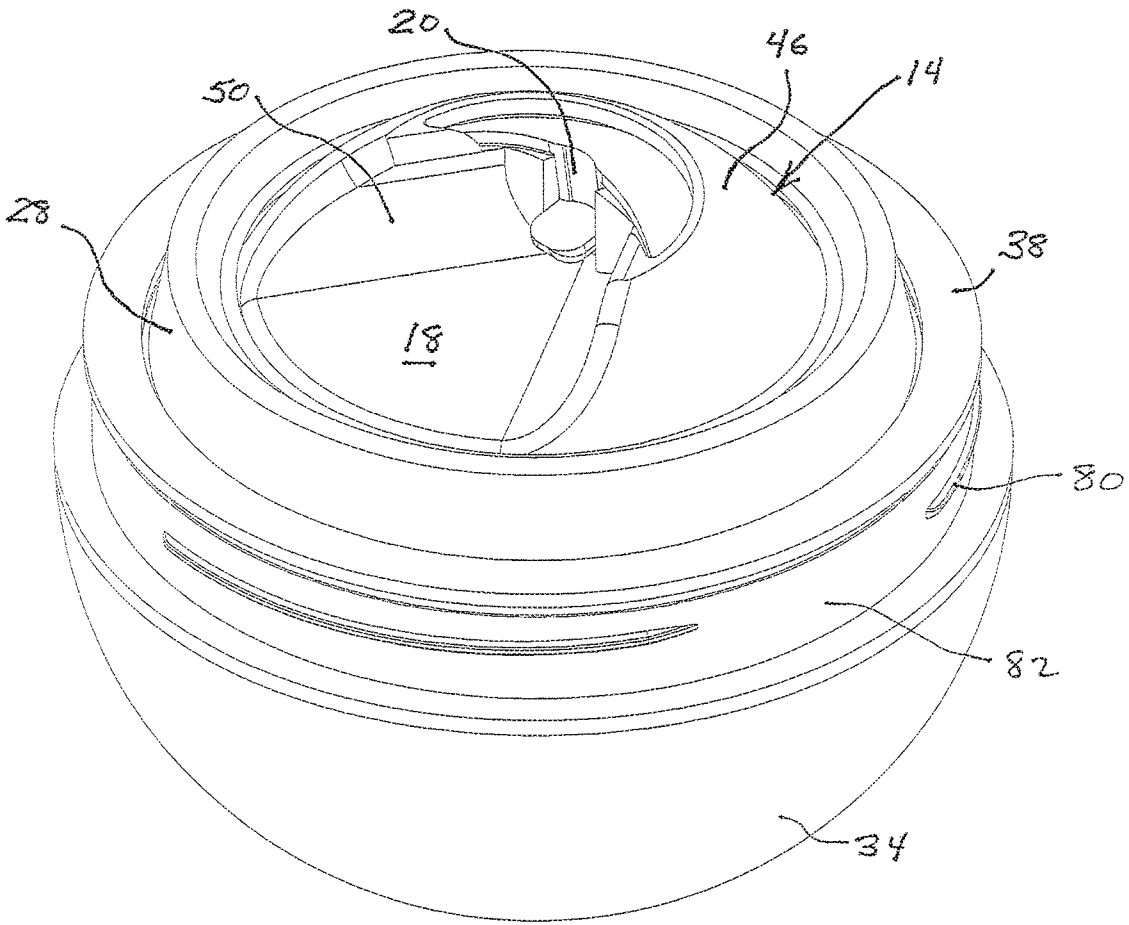
FIG. 5 is a view similar to FIG. 1, with the cap removed.
Figure 6:
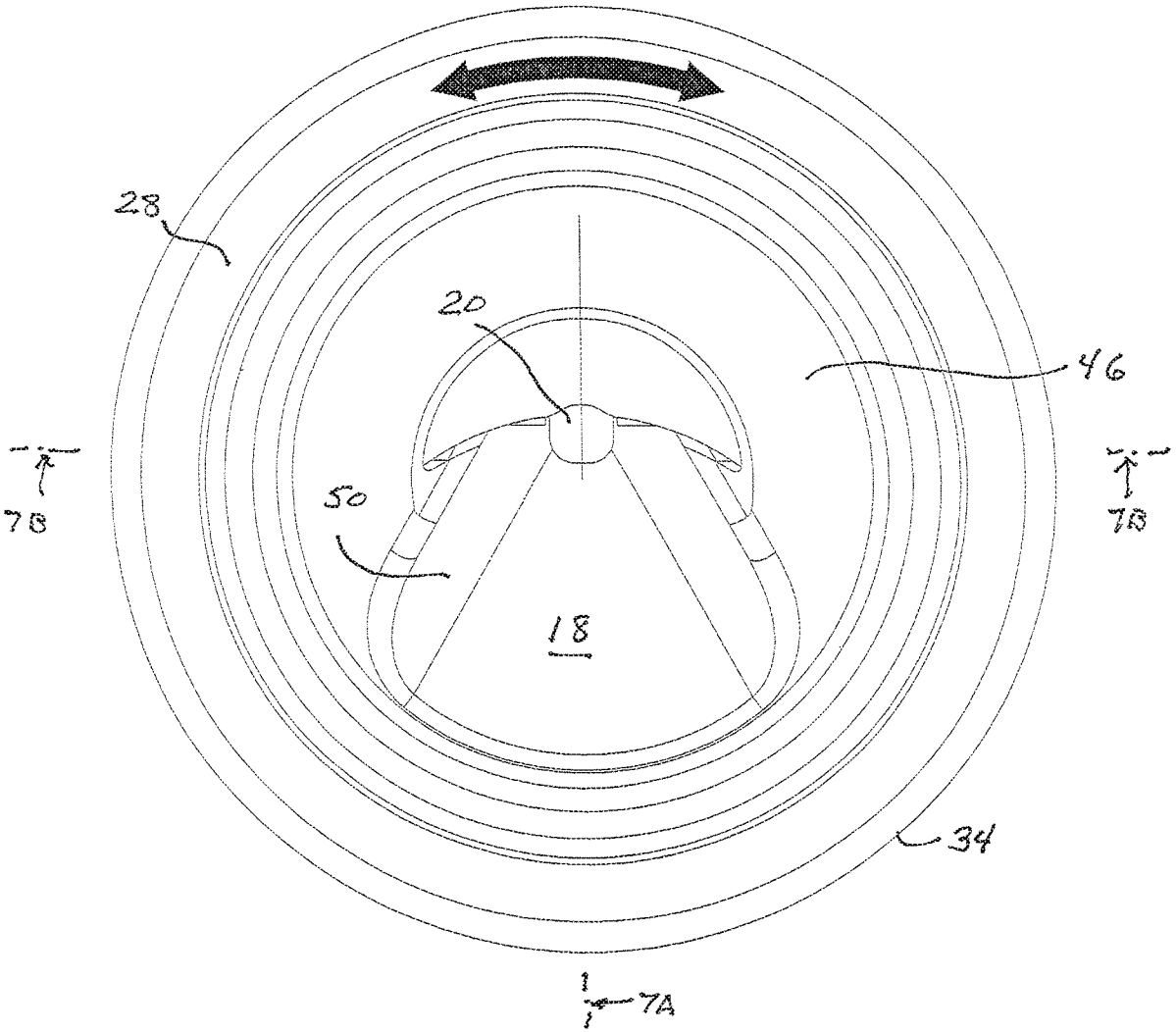
FIG. 6 is a view similar to FIG. 2, with the cap removed.
Figure 7A:
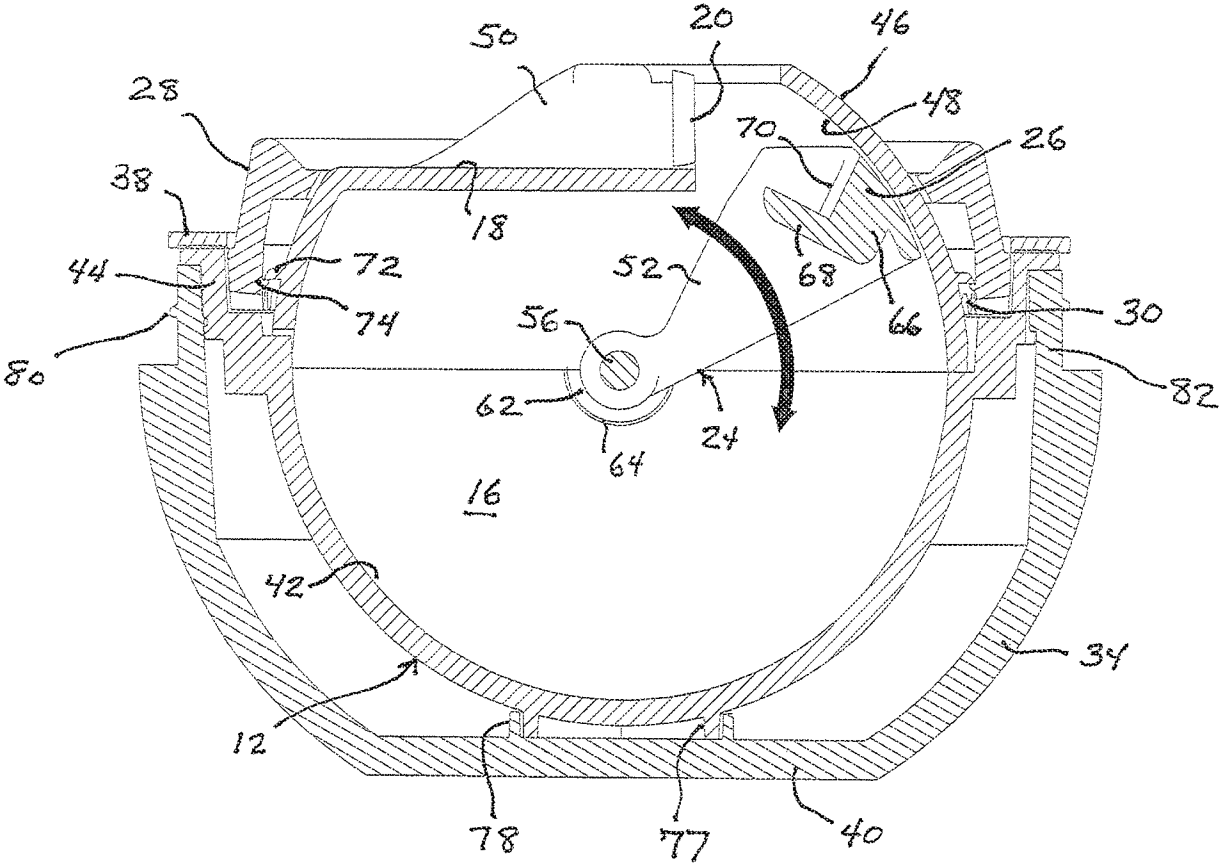
FIG. 7A is a sectional elevational view taken as along line 7A-7A of FIG. 6.
Figure 7B:
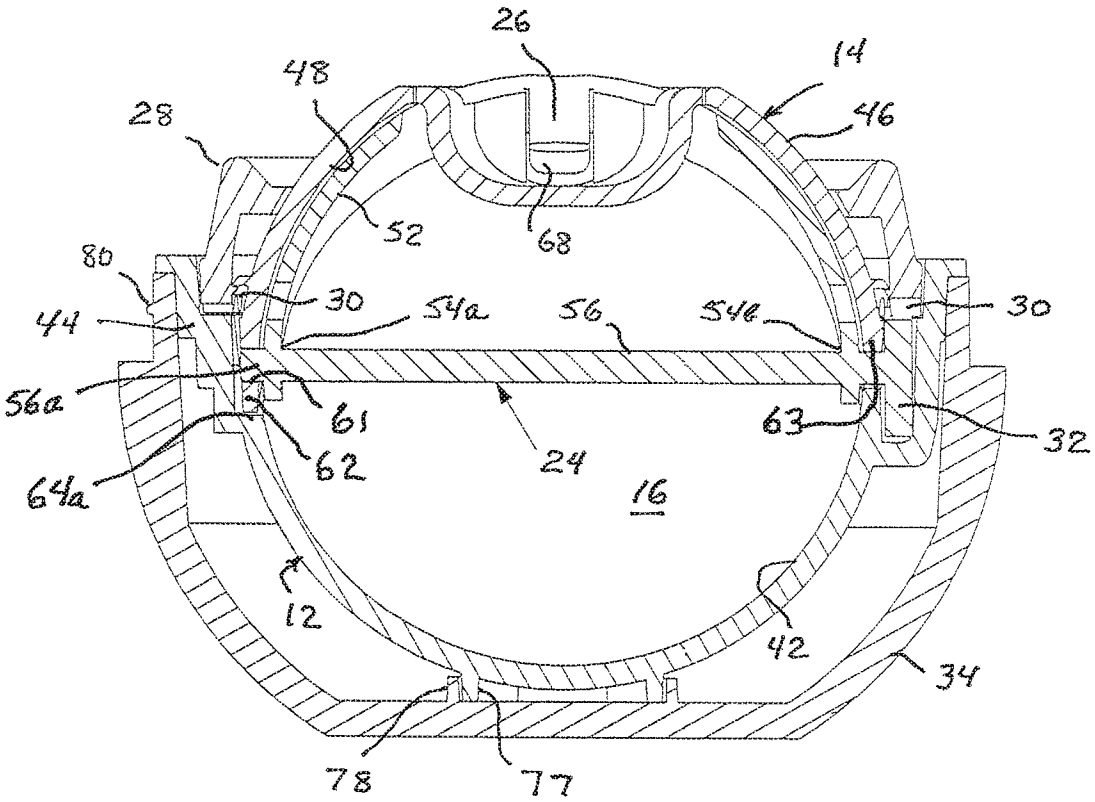
FIG. 7B is a sectional elevational view taken as along line 7B-7B of FIG. 6.
Figure 8A:
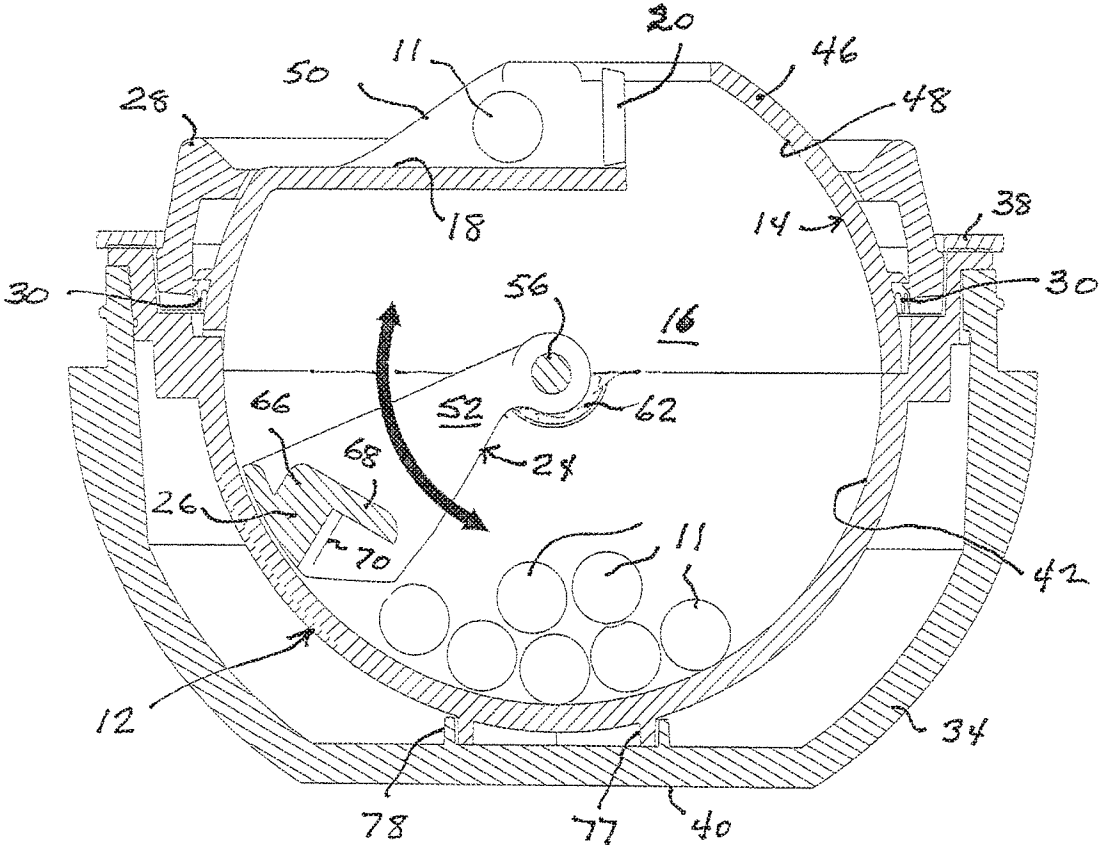
FIGS. 8A and 8B are views similar to FIG. 7A showing successive positions of the wiper as the wiper sweeps the chamber and delivers a bead to the opening and platform.
Figure 8B:
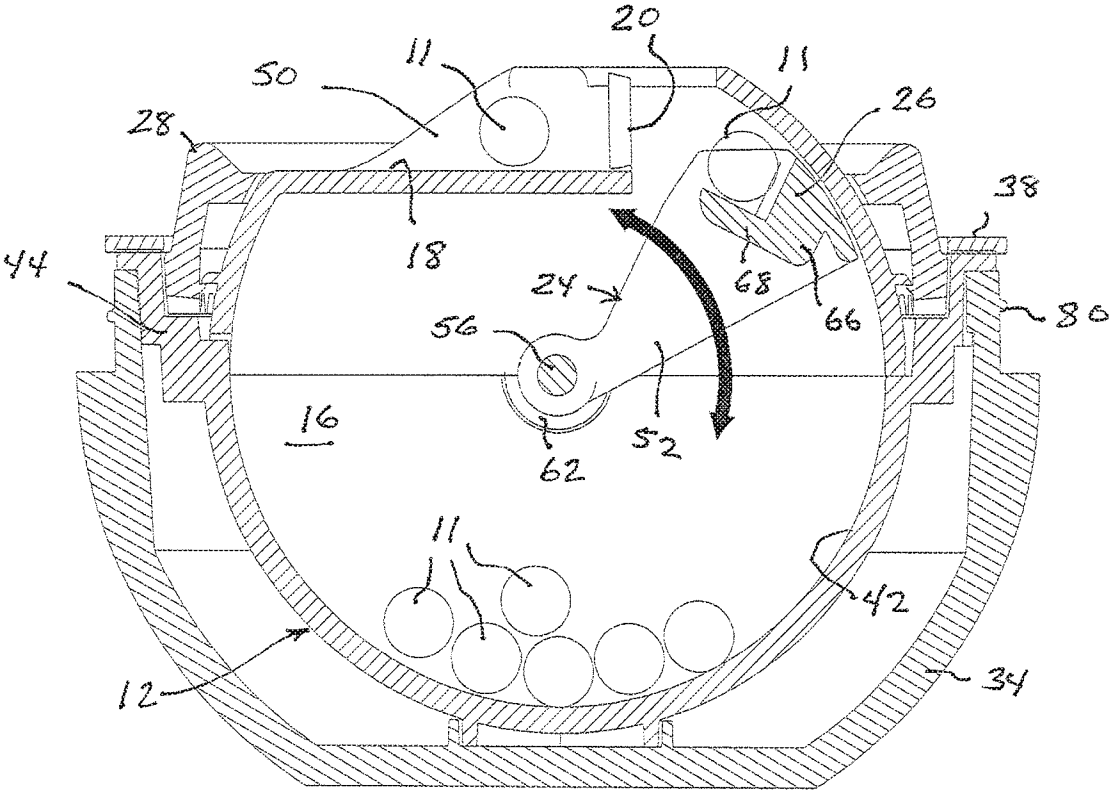

Fixed in the center of wiper member 52 (midway between points 54*a* and 54*b* thereof), and conveniently molded integrally therewith, is the aforementioned dispensing scoop 26, which is a rigid, forwardly open L-shaped finger dimensioned to receive and capture a single one of the beads 11 and push the captured bead forward and upward from the bottom of chamber 16 to the opening 20 each time the wiper is rotated forwardly and upwardly from the FIG. 8A position to and beyond the FIG. 8B position. This dispensing scoop 26 has a rear portion 66 projecting inwardly from the forward edge of member 52 generally toward the center of chamber 16 and an inner portion 68 projecting forwardly from portion 66 in spaced relation to the spherical inner wall of chamber 16. Portion 66 is forwardly concave with side edges 70 for retaining a captured bead against lateral displacement out of the dispensing scoop as the dispensing scoop advances forwardly and upwardly to the opening; the spacing between edges 70, and between portion 68 and the chamber-defining spherical inner wall 42, 48, is selected to accommodate a single bead 11.

When the wiper 24 is rotated forwardly from the position of FIG. 8A and upwardly through the position shown in FIG. 8B, with a plurality of beads in the chamber 16, the lune-shaped member 52 sweeps along the conformingly spherical inner wall of the chamber, into and through the body of contained beads. This movement displaces the beads within the chamber, but since the member is shaped as a lune of a hollow sphere, with the above-described rounded edges and limited thickness, it does not propel them upwardly to the top of the chamber; instead, as the member 52 advances, all but one of the beads flow over its curved inner surface and return to the bottom of the chamber. The sweeping action of the wiper overcomes any tendency of the beads to stick to each other and/or to the chamber wall.

As the sweeping wiper carries the forwardly open bent finger dispensing scoop 26 down into the plurality of beads, the dispensing scoop engages and captures a single one of the beads at the bottom of the chamber and carries it forwardly all the way up to the opening 20. The dimensions between the dispensing scoop portion 68 and the chamber wall, and between the side edges 70, prevent the dispensing scoop from carrying more than one bead out of the body of contained beads; the outer surfaces of the dispensing scoop are shaped and oriented so that when the dispensing scoop is plunged into a pile of beads at the bottom of the chamber, all the beads it engages other than the single captured bead will flow over or around the dispensing scoop structure and return to the chamber bottom as the dispensing scoop rises from the mass of beads.

The single bead captured by the dispensing scoop and pushed by portion 66 from the bottom of the chamber to the opening 20 is initially supported by the chamber inner wall and laterally confined by the edges 70. As the dispensing scoop rises, the captured bead becomes supported by the rear dispensing scoop portion 66 and laterally confined by the edges 70, dispensing scoop portion 68 and the chamber wall. Finally, as it approaches opening 20, the captured bead is supported by dispensing scoop portion 68 and laterally confined by rear dispensing scoop portion 66 and edges 70. At the top of the wiper sweep cycle, the forwardly open dispensing scoop is brought into register with opening 20 and the transported bead rolls or falls through the opening onto platform 18 where it is manually picked up by a user.

Figure 13:
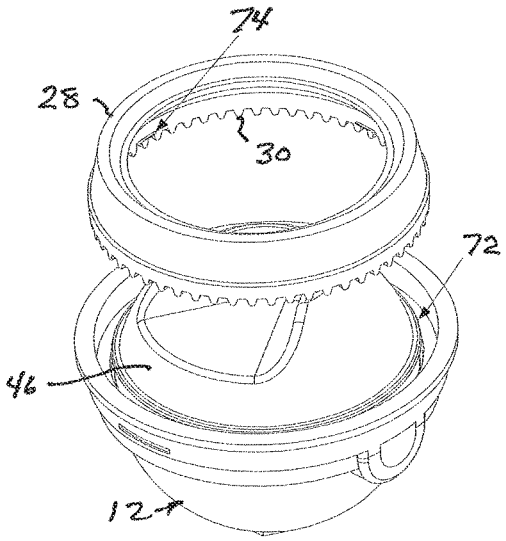
FIG. 13 is a perspective view illustrating the assembly of the geared ring and the platform member.

The geared ring 28 is a unitary annular element molded of plastic together with its 360° array of vertical teeth 30, and is snap-fitted onto the exterior of dome 46 of platform member 14 by means of an annular projection 72 (molded on the dome outer surface) and snaps 74 (molded on the ring inner surface, see FIG. 13), so as to be manually rotatable about a vertical axis extending through the geometric center of chamber 16. The upper edge of the ring, projecting above the platform 18, cooperates with the structure 50 to prevent delivered beads from falling off the platform. When the wiper 24 is rotatably mounted in bearings 62, the teeth 30 of ring 28 mesh with the teeth of gear 32. Since the diameter of the array of teeth 30 is substantially larger than the diameter of gear 32, a relatively small angular displacement of the geared ring effects a substantially greater angular displacement of the wiper within the chamber; hence only short single twists of the geared ring are needed to produce full forward sweeping and rearward return cycles of angular movement of the wiper.

Figure 14:
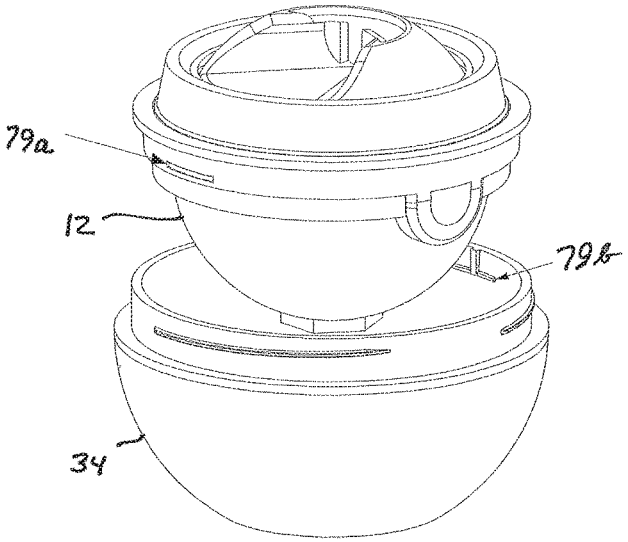
FIG. 14 is a perspective view illustrating the assembly of the jar and the base.
Figure 15A:
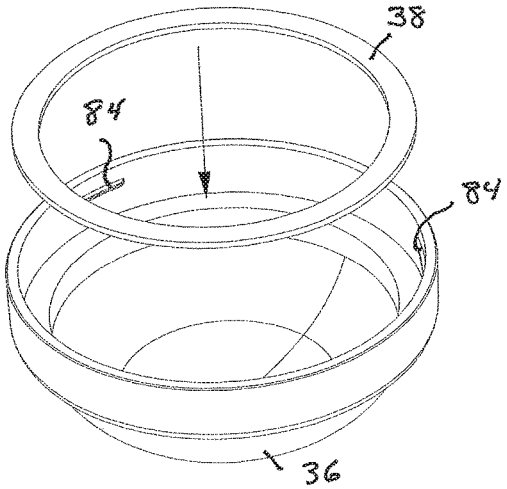
FIGS. 15A and 15B are perspective views illustrating assembly of the cap and the base.
Figure 15B:
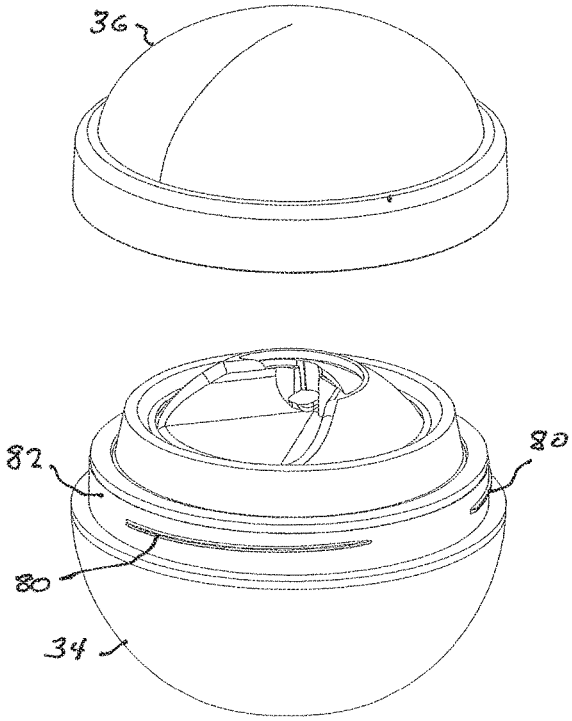

In the assembled container constituted of the platform member and jar, the upper flange 44 of the jar surrounds and protects the lower toothed portion of geared ring 28 as well as gear 32. The jar 12 has a hexagonal annulus 77 projecting from its bottom and insertable in a mating hexagonal socket 78 molded inside base 34 to prevent relative rotation of the base and jar when the jar is disposed in the base; the jar and base are secured together by snaps 79*a*, 79*b* (FIG. 14) respectively molded on their facing surfaces. Threads 80 molded on the outer surface of the mouth 82 of the base are engaged by inner threads 84 on cap 36 (FIGS. 15A and 15B). The gasket 38 is inserted into the cap so as to be clamped between the flange 44 of jar 12 and the cap to seal the dispenser for storage.

The operation of the dispenser of FIGS. 1-10 may now be readily explained. With the chamber 16 containing a plurality of beads of uniform size and shape, a user grasps the base 40, unscrews the cap 36 and, holding the base, twists the geared ring 28 in a first direction to ensure that the wiper 24 is in an initial (rearward) position as exemplified in FIG. 8A. The user then twists the ring 24 in the opposite direction, moving the wiper forward to sweep the chamber wall through and beyond the contained plurality of beads 11 and on up through the position shown in FIG. 8B until the dispensing scoop (carrying a single bead) reaches the opening 20, where the transported single bead rolls or falls from the dispensing scoop onto the platform 18 for manual pickup by the user. The ring 28 can then be twisted back to restore the wiper to the initial position for another sweeping and bead-delivering cycle. Each twisting manipulation is a single short stroke, and even at the outset of operation the user twists the ring back and forth only once to get a bead. The bead-dispensing procedure may be repeated as often as desired; between dispensing operations the cap is screwed on the dispenser, and the dispenser with its remaining content of beads is stored.

The configuration of the wiper member 52 and the outer surfaces of the dispensing scoop 26 is such that although the plural beads in the chamber are disturbed in each sweeping and bead delivering cycle, none of them are lifted out of the chamber 16 except for the single bead captured and transported by the dispensing scoop in each cycle. Instead, they simply flow over the wiper and back down to the bottom of chamber 16 as the wiper sweeps through them. At no point in the sweeping and delivery cycle are the beads subjected to mashing or other harsh mechanical action, so there is no damage even to very weak or fragile beads.

In this way, one and only one bead is reliably discharged each time the geared ring is subjected to a short forward twist. Even when only one bead remains in the container, it is reliably discharged, because it is positioned by gravity at the lowermost point in the spherical chamber, which lies in the vertical plane of rotation of the centered dispensing scoop on the wiper.

Advantageously, whenever the dispenser is not being used to discharge beads and the cap 36 is mounted on the base 34, the opening 20 is blocked to prevent escape of beads therethrough from the chamber 16 incident to tilting or inversion of the dispenser. The opening 20 may conveniently be blocked by positioning and maintaining the wiper 24 at its extreme bead-delivering position adjacent the opening 20 except when the wiper is being intentionally and positively subjected to rotation by manual turning of the geared ring 28. For instance, the wiper 24 may be automatically held at a selected end of its rotational path (e.g. the path end adjacent the opening) upon manual release of the geared ring. In exemplary embodiments, the ring 28 or the wiper 24 itself may be arranged to be subjected to a spring bias or other force that automatically moves the wiper to (or holds it at) the selected path end upon manual release of the geared ring.

Figure 18:
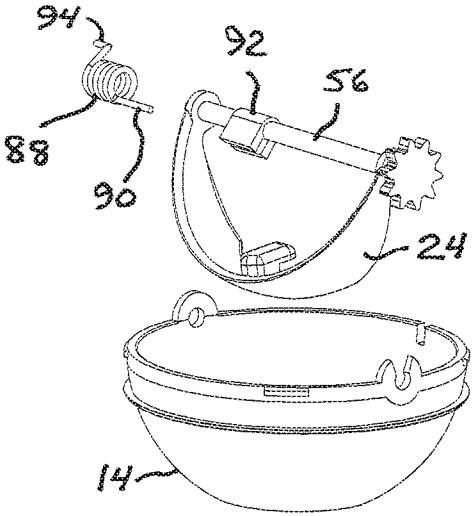
FIG. 18 is an exploded perspective view, similar to FIG. 11A, of the wiper and the platform member with a torsion spring for returning the wiper to and maintaining the wiper at its position closing and blocking the opening 20.

One such embodiment is illustrated in FIG. 18 which shows, in exploded view, a torsion spring 88 that drives the wiper 24 into the closed position, i.e. the extreme position (in the path of wiper rotation) at which the wiper delivers a bead to the opening 20 and blocks the opening to prevent passage of other beads therethrough. When assembled with the wiper and the platform member 14, the helical spring surrounds a portion of the spindle 56 and has one end 90 inserted into a slotted element 92 fixed to the spindle; an opposite end 94 of the spring is received in adjacent nonrotating dispenser structure so as to be held against rotation with the spindle. Since the wiper is geared to the ring 28, as it is forced to rotate by the spring 88, it also rotates the ring. Consequently, the user merely needs to twist the ring until the wiper is in the open position (primed to wipe the chamber); the spring will then ensure that the ring and wiper are automatically returned to the position at which a bead is dispensed through the opening.

Figure 17:
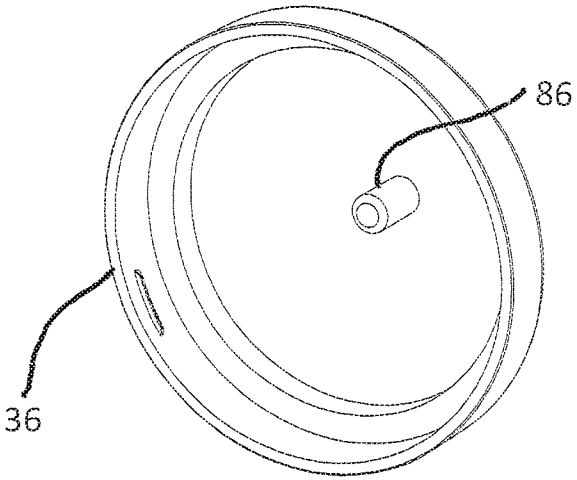
FIG. 17 is a perspective view of the interior of the cap of FIG. 16.
Figure 16:
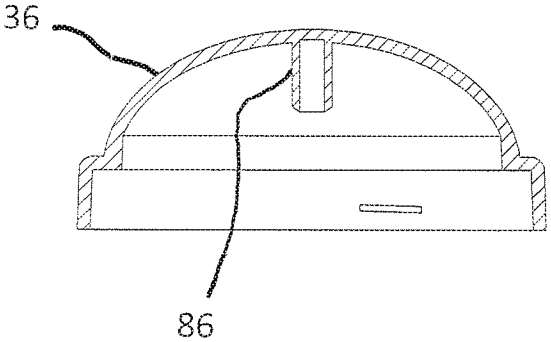
FIG. 16 is a sectional view of the cap in an embodiment of the invention in which the cap has a post for blocking egress of beads from the chamber through the opening when the cap is mounted on the base.

Additionally or alternatively, as shown in FIGS. 16 and 17, the cap 36 may have an inner surface with a rigid post 86 projecting inwardly along the vertical axis of the chamber 16 (which is also the axis of rotation of the cap as it is mounted on or removed from the base 34). The post 86 may conveniently be cylindrical in shape and molded integrally with the plastic cap 36; it is positioned and dimensioned to block beads within the chamber 16 from passing outwardly through the opening 20 to the platform 18 when the cap 36 is mounted on the base 12 and to enable the cap to be screwed on and removed from the base 12 clear of interference between the post and the structure defining the opening 20 and platform 18.

While the dispensing scoop is tailored to capture and transport single beads of a particular size and shape, the dispenser can be adapted for other beads of different size and/or shape by simply replacing the wiper, and orifice-defining structure of the platform member, with others of appropriate configuration and dimensions. Dispensers of the invention may be employed with a wide variety of different types of beads used, for example, in the cosmetics, food, nutrition and medical industries.

It is to be understood that the invention is not limited to the features and embodiments hereinabove specifically set forth, but may be carried out in other ways without departure from its spirit.

What is claimed is:

1. A sweep bead dispenser comprising a container for holding a plurality of beads in a chamber having an inner wall which is a surface defined by revolution of a generatrix about a horizontal axis, the container having an externally accessible platform at the top and an opening for discharging individual beads from the chamber to the platform; a wiper disposed within, and rotatable about the aforesaid horizontal axis of, the chamber for sweeping the chamber inner wall to capture and convey a single bead upwardly to the opening for discharge to the platform while leaving all other beads of the contained plurality within the chamber; a first gear mounted on the container for manual rotation; and a second gear secured to the wiper and driven by the first gear for effecting sweeping rotation of the wiper when the first gear is turned.

2. The dispenser of claim 1, wherein the second gear is smaller than the first gear whereby an angular displacement of the first gear effects a larger angular displacement of the wiper.

3. The dispenser of claim 1, wherein the wiper extends along the chamber inner wall for at least substantially the entire distance between opposite intersections of the aforesaid horizontal axis with the chamber inner wall, and comprises a dispensing scoop to capture a single bead and convey the captured bead upwardly to the opening for discharge to the platform as aforesaid, and a rigid sheet or plate conforming in contour to a portion of the aforesaid surface of revolution and closely adjacent the chamber inner wall, so that when the wiper sweeps the chamber, beads not captured by the dispensing scoop flow over the wiper back into the chamber.

4. The dispenser of claim 3, wherein the chamber inner surface has a lowermost point lying in a vertical plane that bisects the dimension of the chamber measured along the aforesaid horizontal axis, the dispensing scoop is disposed centrally on the wiper to rotate therewith in the same vertical plane, and the opening is located in register with the plane for receiving a bead from the dispensing scoop.

5. The dispenser of claim 1, wherein the surface of revolution is interrupted in an upper portion of the chamber by the platform and the opening.

6. The dispenser of claim 1, wherein the generatrix is a great circle and the surface of revolution is a sphere.

7. A sweep bead dispenser for delivering single beads, one by one, from a contained plurality of the beads, comprising (a) a container for holding plural beads in a chamber defined by a spherical inner wall, the container having an externally accessible platform at the top and an opening for discharging individual beads from the chamber to the platform;

(b) a wiper disposed within, and rotatable about a horizontal axis of, the chamber for sweeping the chamber inner wall to capture a single bead and convey the captured bead upwardly to the opening for discharge to the platform while leaving all other beads of the contained plurality within the chamber;

(c) a first gear mounted on the container for manual rotation; and (d) a second gear secured to the wiper and driven by the first gear for effecting sweeping rotation of the wiper when the first gear is turned.

8. The dispenser of claim 7, wherein the first gear is a geared ring mounted on the container for manual rotation about a vertical axis of the chamber; and the second gear, secured to the wiper, meshes with and is driven by the geared ring.

9. The dispenser of claim 7, wherein the container comprises a jar with a semispherical inner wall constituting a lower portion of the chamber inner wall and a platform member including the platform, the opening, and a dome with a semispherical inner wall constituting an upper portion of the chamber inner wall.

10. The dispenser of claim 9, wherein the wiper comprises a member having the shape of a lune of a hollow sphere concentric with and closely adjacent the chamber inner wall such that when the wiper sweeps the chamber inner wall it displaces all beads held in the chamber, and a dispensing scoop fixedly mounted in a central location of the wiper and configured to capture and transport a single one of the contained beads to the opening as the wiper sweeps upwardly, for discharge of said single one of the beads through the opening to the platform, while all other contained beads remain in the chamber.

11. The dispenser of claim 10, further including a base surrounding the jar, a cap surrounding the platform member and threaded on the base, and a gasket disposed between and engaging the jar and the cap for sealing the container.

12. The dispenser of claim 11, wherein the cap has an inner surface with a post projecting inwardly along the vertical axis of the chamber, the post being positioned and dimensioned to block beads within the chamber from passing outwardly through the opening when the cap is mounted on the base and to enable the cap to be mounted on and removed from the base clear of interference between the post and structure defining the opening and platform.

13. The dispenser of claim 8, wherein manual rotation of the geared ring moves the wiper rotationally along a path having opposite ends including a position for discharge of a bead from the wiper through the opening to the platform, and wherein the wiper is automatically moved to or held at a selected one of said ends upon manual release of the geared ring.

14. The dispenser of claim 13, wherein the wiper is subjected to a bias force such that said wiper is moved to or held at said selected one of said ends upon manual release of the geared ring.

15. The dispenser of claim 14, including a torsion spring acting between the wiper and dispenser structure that does not rotate with the wiper, for biasing the wiper to the position at which the wiper delivers a bead to the opening and blocks the opening.

* * * * *